United States Patent [19]

Fathi

[11] Patent Number: 4,571,483

[45] Date of Patent: Feb. 18, 1986

[54] PORTABLE STEAMER

[75] Inventor: Saul S. Fathi, Huntington, N.Y.

[73] Assignee: Traveltec International, Inc., Great Neck, N.Y.

[21] Appl. No.: 635,554

[22] Filed: Jul. 30, 1984

[51] Int. Cl.[4] ..... A47J 51/00

[52] U.S. Cl. ..... 219/271; 219/275; 219/367; 38/69

[58] Field of Search ..... 219/271, 272, 273, 275, 219/276, 362, 373, 274, 366, 367, 368, 369, 370; 223/51; 239/135, 136; 38/77.5, 69, 77.8, 77.7, 77.82, 77.9, 85, 88, 89, 77.4; 4/535-537; 43/129, 130

[56] References Cited

U.S. PATENT DOCUMENTS

| | | | |
|---|---|---|---|
| 2,763,075 | 9/1956 | Vance | 38/77.4 |
| 2,962,576 | 11/1960 | Russell | 219/370 |
| 3,395,469 | 8/1968 | Gilbert | 38/69 |
| 3,470,719 | 10/1969 | Frank | 219/271 |
| 3,620,055 | 11/1971 | Blachly | 219/273 |
| 3,654,780 | 4/1972 | Frank | 219/271 |
| 3,695,066 | 10/1972 | Doyel | 38/69 |
| 3,742,629 | 7/1973 | Plasko | 38/39 |
| 3,755,649 | 8/1973 | Osrow | 38/77.5 |
| 3,809,503 | 5/1974 | Schlicker | 219/366 |
| 3,811,208 | 5/1974 | Vieceli | 219/275 |

FOREIGN PATENT DOCUMENTS

| | | | |
|---|---|---|---|
| 885053 | 11/1971 | Canada | 219/272 |
| 0104048 | 3/1984 | European Pat. Off. | 38/85 |

*Primary Examiner*—C. L. Albritton
*Assistant Examiner*—Teresa J. Walberg
*Attorney, Agent, or Firm*—Edward H. Loveman

[57] ABSTRACT

This portable steamer device has a central cylindrical casing open at opposite ends. A handle is rotatably mounted to a cylindrical cap attached to the rear end of the casing. A baffle is mounted to the front end of the casing, and has holes for emitting steam. In the casing is a heater assembly to heat water in a first chamber conically shaped body with a central aperature closes the chamber but permits water to pass into the chamber and steam to pass out of the chamber. A tube section inside a second chamber between the baffle and the body which passes steam to the baffle while any water which may inadvertently spill out of the first chamber is captured in the second chamber, thus, water cannot leak out of the device.

10 Claims, 11 Drawing Figures

PORTABLE STEAMER

This invention relates to the art of portable hand held steamer devices or appliances for steaming and removing wrinkles from garments, drapes, and other fabric articles.

Prior conventional hand held steamers generally present a number of objectionable features. For examples: They must be held upright while in use; if they are tipped slightly forward or backward hot water sprays or leaks out. Some have large hollow handles to contain water which is vaporized into steam during use. The handles are so attached to spray nozzles that the steamers are heavy and clumsy to hold and use; and they are bulky so that they occupy a great deal of space in a traveller's luggage. Heretofore, the nozzle has been attached to the body of the steamer by screw threads and the nozzle can be rotated too far due to excessive force used in tightening or due to wear of the gasket between the nozzle and the steamer body. This causes disorientation of the nozzle thus making use of the prior steamer inefficient and often unsafe. If the holes in the nozzle are clogged, steam pressure may build up excessively in the prior steamers making explosion of the devices possible. If the holes are only partially clogged, the steam is ejected with excessive force which is dangerous and undesirable.

The present invention is directed at overcoming the above and other difficulties and disadvantages of prior hand held steamer appliances. According to the invention, there is provided a steamer device having a cylindrical body or casing in which is a first chamber for containing water to be heated into steam. A baffle is removably mounted on the front end of the cylindrical casing. Between the baffle and casing is interposed a funnel-like partition. Inside the baffle is a flattened tubular passage for conducting steam to steam ejection holes. A second chamber is defined inside the baffle to receive water which may spill out of the first chamber, if the steamer is tilted excessively from the vertical. When the steamer is vertical with the baffle positioned upwardly, the water from the second chamber runs back to the first chamber. Thus, it is not possible for water to leak out of the device regardless of the position of the device. A further improvement of the device is in the construction of its handle which is grasped by the user during operation of the device. The handle is rotatable between two detent positions. In retracted position the handle is longitudinally disposed axially parallel to the tubular casing of the steamer. This minimizes the space occupied by the device during storage. During use, the handle is extended perpendicularly to the longitudinal axis of the tubular casing. The shape of the front baffle makes it possible to use the device as steam iron.

Other desirable, improved features of the device are its maximum use of lightweight, inexpensive, strong, durable, plastic parts; and novel construction which makes manufacture and assembly simple and secure. Since the device has no external metal parts, it is always comfortable to hold and safe to use.

These and other objects and many of the attendant advantages of this invention will be readily appreciated as the same becomes better understood by reference to the following detailed description when considered in connection with the accompanying drawings in which.

Figure 2:
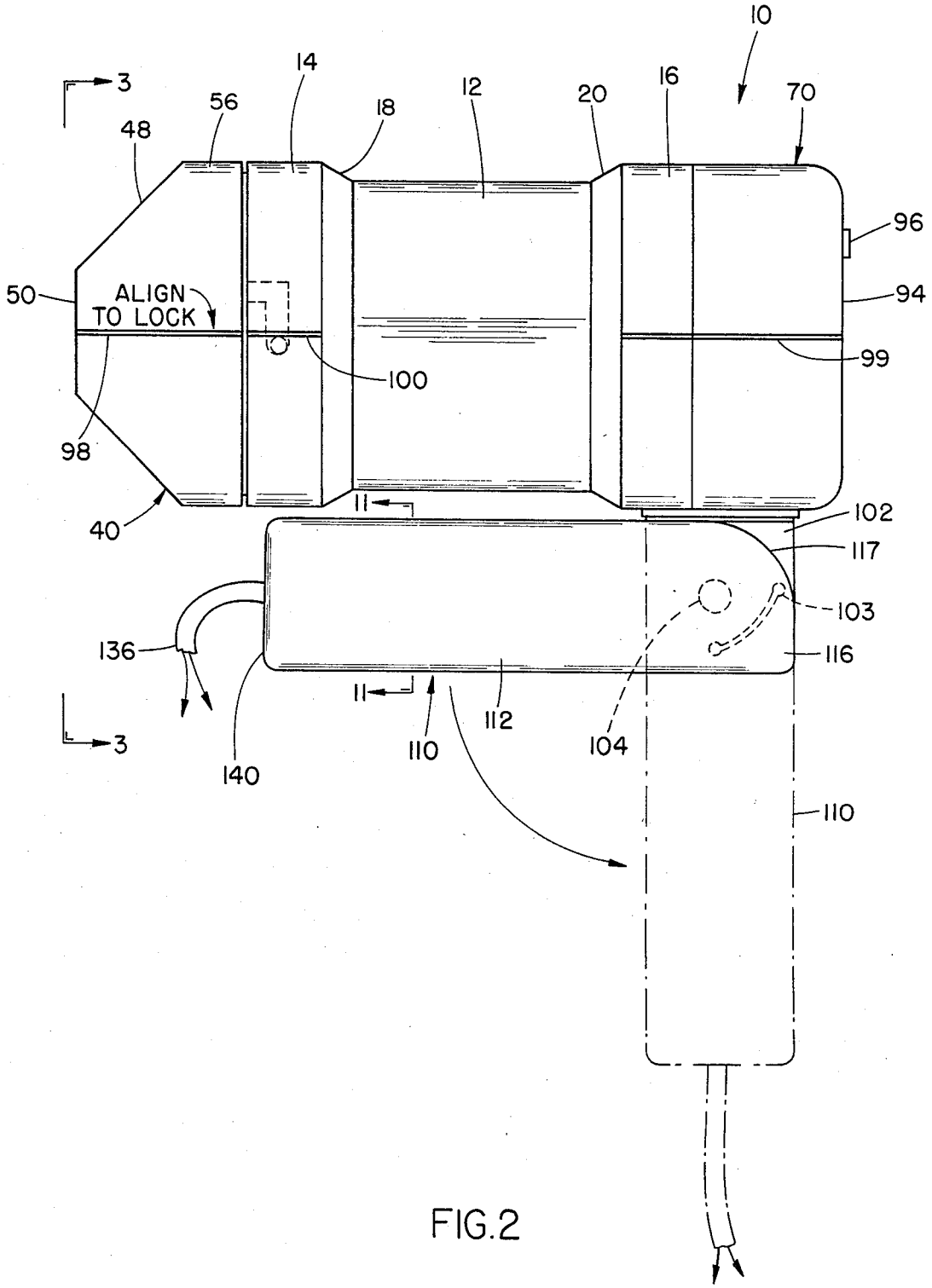
FIG. 2 is a side elevational view of the steamer device with handle shown in retracted position.
Figure 5:
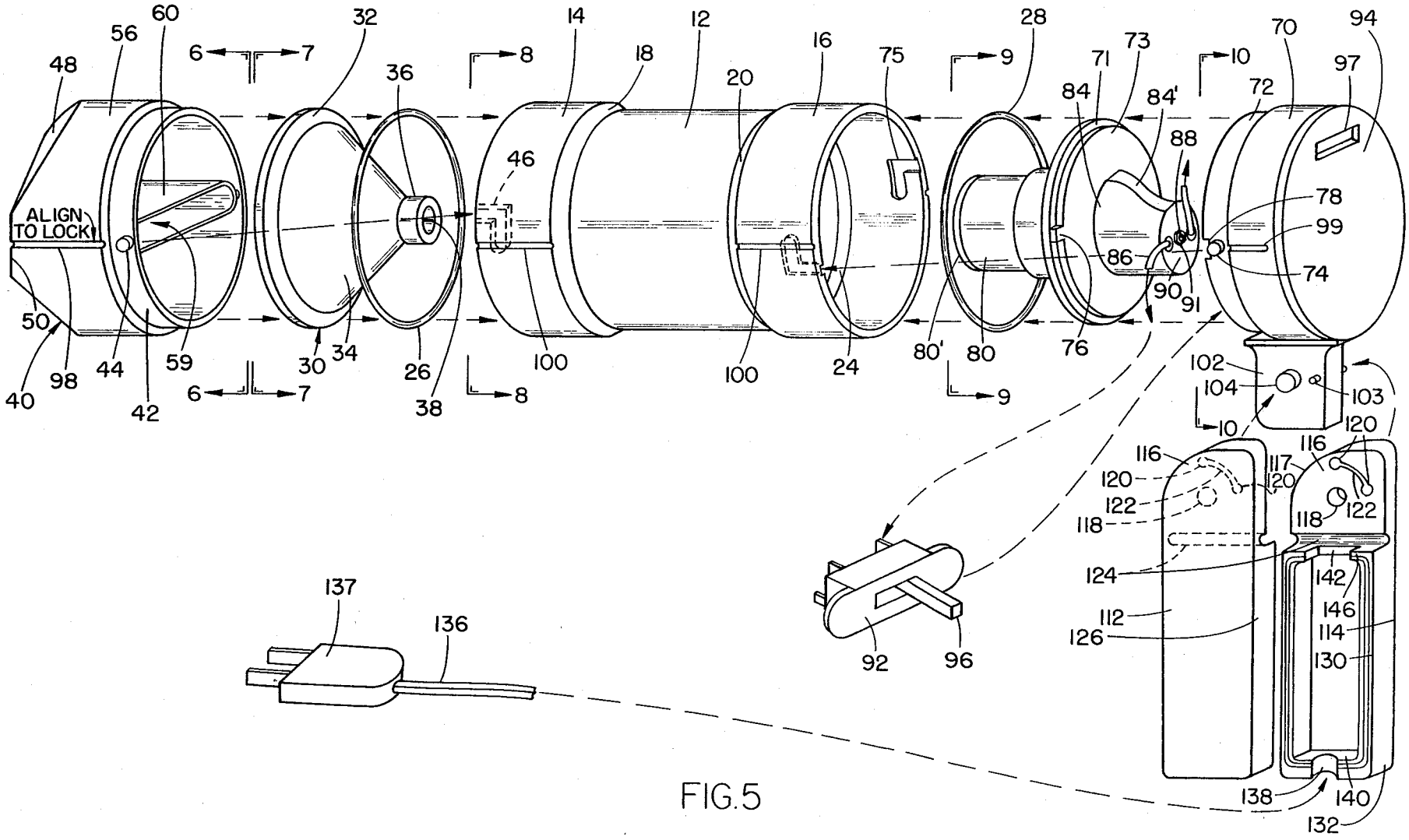
FIG. 5 is an exploded perspective view of parts of the steamer device.
Figure 8:
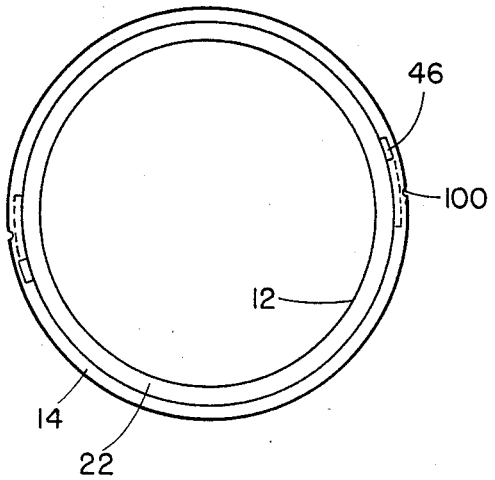
Figure 11:
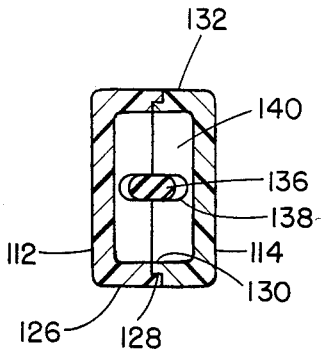

FIGS. 6–10 are end elevational views of parts of the device taken along lines 6—6 through 10—10 respectively of FIG. 5; and FIG. 11 is a cross sectional view of the handle taken along line 11—11 of FIG. 2.

Referring now to the drawings wherein like reference characters designate like or corresponding parts throughout, there is illustrated in FIGS. 1–5, a steamer device or appliance generally designated by reference numeral 10 having a rigid, hollow cylindrical body 12 formed with diametrally larger cylindrical end flanges 14, 16, each integrally joined with frusto-conical transition section 18, 20. Inside the sections 18 and 20 are respective annular grooves 22, 24 (FIG. 4) which receive respective toroidal, resilient sealing "O" rings or gaskets 26, 28. A funnel shaped partition 30 has an annular flange 32 which abuts the gasket 26; see FIGS. 4, 5, and 7, and a tapered frusto-conical body 34 which extends axially inwardly away from the front end of the cylindrical body or casing 12 and terminates in a cylindrical neck 36 having a central opening 38. A nozzle or baffle 40 is removably attached to the front end of the casing 12 and has a cylindrical rear end flange 42 which fits slidably into the cylindrical flange 14 of the casing 12. Diametrally opposed axially aligned pins 44 at opposite sides of the flange 42 fit into respective L-shaped grooves 46 at opposite sides of the flange 14; see FIGS. 5 and 8. The pins 44 and grooves 46 when respectively engaged serve as bayonet joints to removably attach the baffle 40 to the front end of the casing 12. The baffle 40 has a pair of flat semi-circular end faces or walls 48 integral with a flat diametral end wall or face 50 in which are spaced through holes 52 extending axially through the baffle 40; see FIGS. 1 and 3. The outer ends 54 of the holes 52 are flared to assist steam exiting from the baffle 40. A groove 49 extends between ends 54 of each pair of adjacent holes 52. The flange 42 extends rearwardly from the cylindrical section 56. Inside the baffle 40 and integral with the inner side of the end wall or face 50 is a flattened, tubular baffle section 60; see FIGS. 5 and 6. A chamber 62 is defined in the baffle 40 around the tubular section 60. The through holes 52 open into the front end of a passage 59 in the section 60. The rear end of the section 60 is open and axially aligned with the passage or opening 38 in the neck 36 of the partition 30.

The device 10 is provided with a cylindrical cup-shaped rear cap 70 which may be plastic molded. The front end of the cap 70 has a recessed cylindrical flange 72 which fits slidably into the cylindrical end flange 16 of the casing 12. The annular front end of the flange 72 abuts an annular flange 71 of a bracket 73 and in turn abuts the "O" rings gasket 28. Each of a pair of axially aligned pins 74 in diametrically opposed positions on the outside of the flange 72 fits into a respective L-shaped groove 75 formed inside the flange 16 of the casing 12 to constitute a bayonet joints with the pin 74, for holding the cap 70 securely on the rear end of the casing 12; see FIGS. 5 and 10. The flange 72 of the bracket 73 has diametrally opposed lands 76 which respectively fit into a notice 78 formed at opposite sides of the flange 72 to keep the bracket 73 from rotating in the casing 12; see FIGS. 5 and 9. The bayonet joints prevent the cap 70 from coming axially off from casing 12 without relative rotation of the cap 70.

Figure 4:
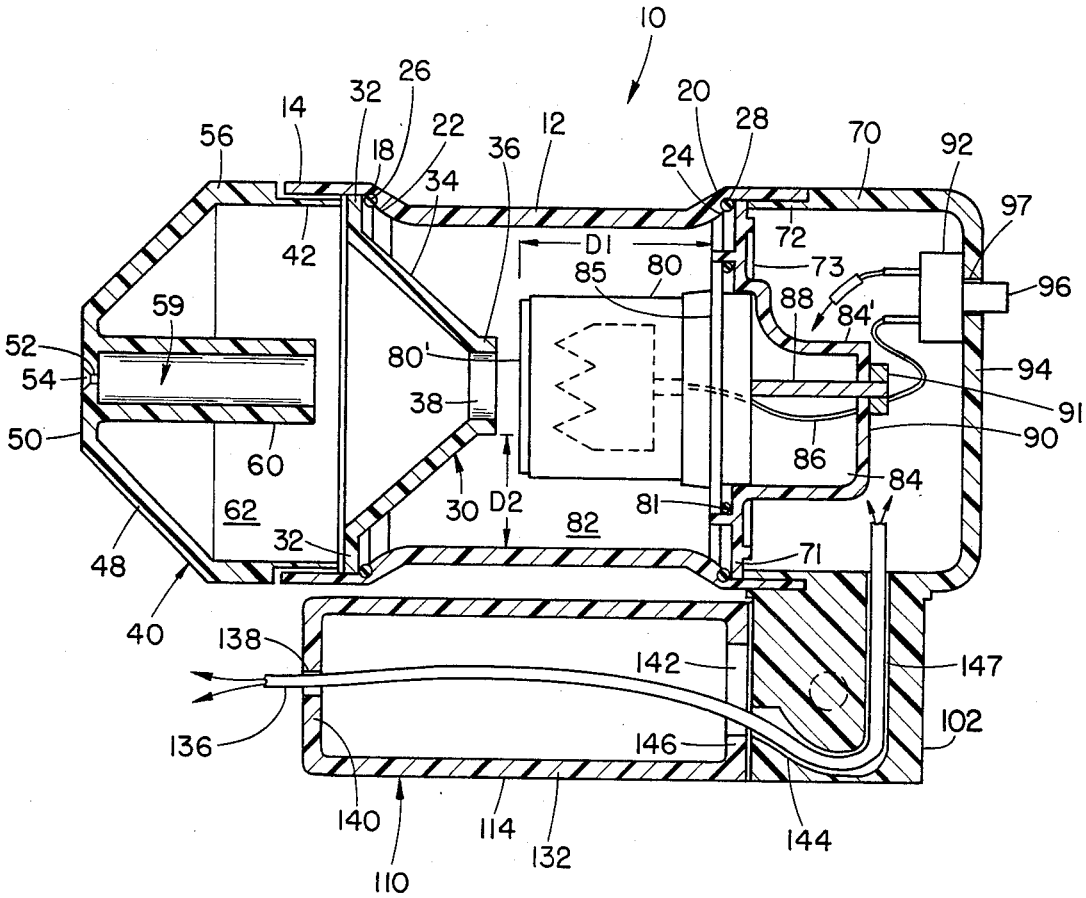
FIG. 4 is a vertical sectional view taken along line 4—4 of FIG. 3.
Figure 6:
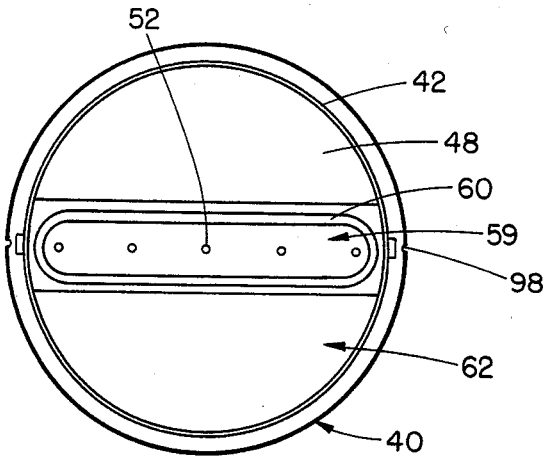
Figure 7:
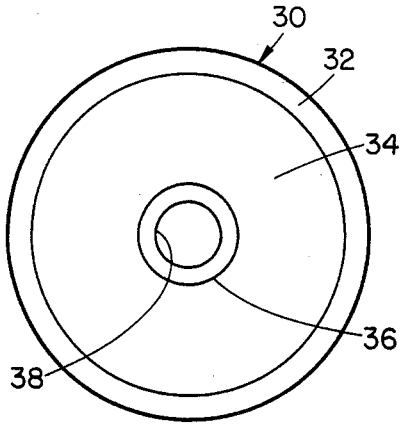
Figure 9:
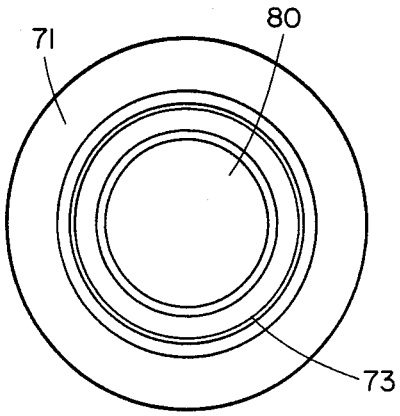
Figure 10:
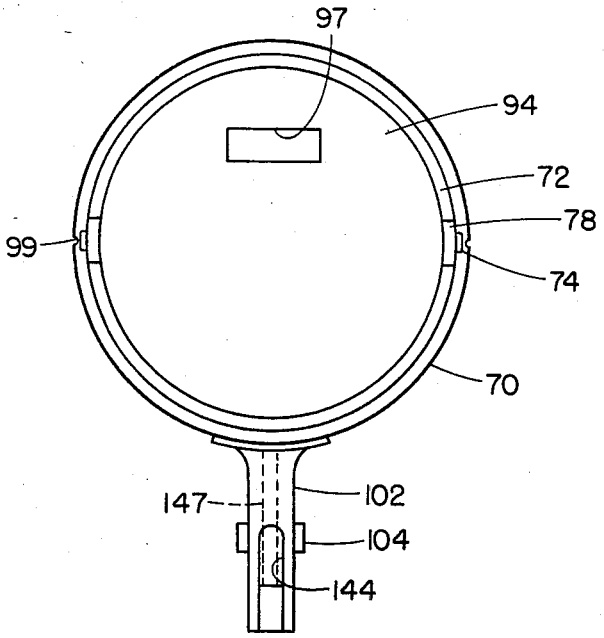

The bracket 73 carries a conventional electrically energizable cylindrical heater assembly 80 which extends axially into a chamber 82 defined by the tubular casing 12, front partition 30 and flange 71 of the bracket 73; see FIGS. 4, 5, and 9. An "O" ring gasket 81 seals a flange 85 of the heater 80 to a flange 71. The bracket 73 has a hollow rear extension 84 through which extend wires 86 connected to the heater assembly 80. A threaded belt 88 extends diametrically rearwardly from the assembly 80 and through a hole in a rear end wall 90 of the bracket extension 84 and is secured by a nut 91. A double pole, double throw switch 92 is mounted on a flat rear end wall 94 of the cap 70 and secured by a pair of nipples or protrusions (not shown) on the inside of the molded plastic cup 70. The holes 92' of the switch 92 are placed onto the protrusions and then heat is applied thereto, which melts the protrusions and secures the switch 92 to the cap 70. A switch handle 96 extends through a hole 97 in the end wall 94 for conveniently operating the switch 92. Diametrally opposed grooves 98 on baffle 40 and diametrically opposed grooves 99 on the cap 70 are alignable with corresponding grooves 100 on respective end flanges 14, 16 of the casing 12. The grooves 100 are disposed circumferentially of the casing 12 so that the front baffle 40 and the end cap 70 are fully and securely engaged with their respective bayonet joints when the respective grooves 98, 99 line up with their respective grooves 100. The cap 70 has an integral radially extending flat block 102 at the bottom thereof. A stub shaft 104 extends laterally from opposite sides of the block 102. Two aligned detent protrusions 103 are formed on opposite sides of the block 102 rearwardly of the shaft 104.

A hollow handle 110 formed of two flat, elongated sections 112, 114 is rotatably engaged on the shaft 104. Each of the handle sections 112, 114 have a flat end plate section 116 with a rounded forward corner 117. Formed on inner sides of the plate section 116 is a recess 118 which receive the shaft 104.

Figure 1:
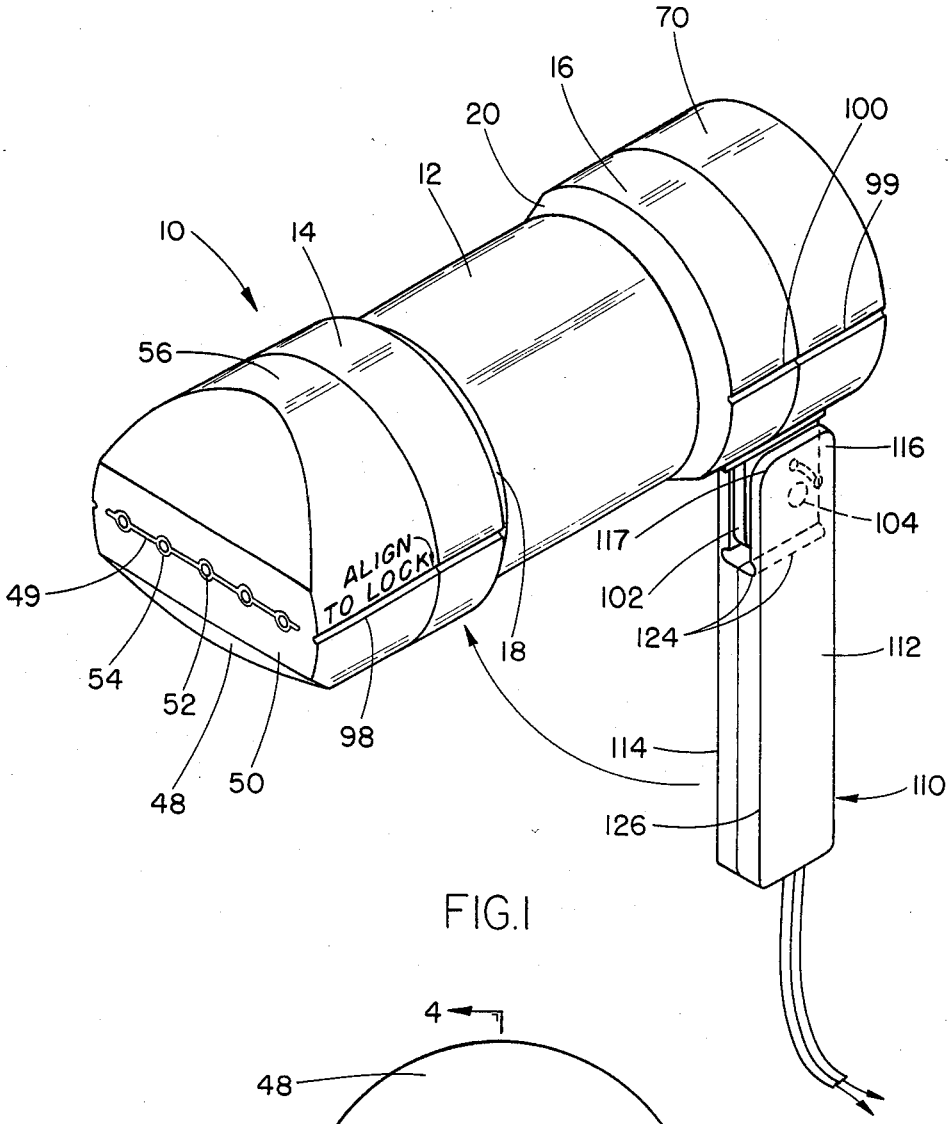
FIG. 1 is an oblique perspective view of a steamer device embodying the invention, with handle shown in extended position.

Two recesses 120 are spaced apart 90° angularly and joined by an arcuate groove 122 and formed on the handle section 116 adjacent the recess 118; see FIGS. 4, 5. A groove 124 formed in each of the handle sections 116 and extending between opposite edges thereof imparts limited flexibility to each of the handle sections 116 so that they can snap into engagement with protrusions 103 in either the extended position of the handle 110 as shown in FIG. 1 or the retracted position shown in FIGS. 2 and 3. The handle section 112 has a rectangular wall 126 formed with a recess or groove 128 which receives a ridge 130 formed on the facing edge of a rectangular wall 132 of the handle section 114; see FIGS. 5 and 11. An electric cable or cord 136 terminates in a plug 137 for connection to an external power source. The cord 136 extends through a hole 138 formed in a bottom, closed end 140 of the handle 110; see FIG. 11. The cord 136 extends upwardly beyond a notch 142 formed in an upper end wall 146 in each of the handle sections 116. The cord 136 extends along an arcuate groove 144 formed in the block 102, then through a bore 147 in the block 102 to the interior of cap 70; see FIG. 4. Inside the cap 70 the wires in the insulated cord 136 are formed into a knot for stress relief not shown, and then the free ends of the wires are connected to contacts of the switch 92 and to the wires 86 of the heater assembly 80 not shown. The bracket extension 84 is curved at its upper side 84' to allow room for the switch 92 and connecting wires.

In assembling the steamer device 10, the switch 92 is installed in the cap 70 and the cable 136 is threaded through the block 102. Then the cable 136 is connected in circuit with the switch 92 and with the heater assembly 80 which has been nested in the bracket 73 with sealing ring 81 therebetween. The "O" ring 28 is placed in the recess 24 in the casing 12 and then the heater assembly 80 and the bracket 73 is inserted into the casing 12. The handle 110 is assembled by fitting both sections 112, 114 to the stub or pivot shaft 104 on the block 102. The ridge and groove 128, 130 on the walls of the handle sections 116 are interfitted after the cable 136 is passed lengthwise through the handle 110. Then the two sections 112, 114, are heat-sealed together to form a unitary handle. The flange 72 of the cap 70 is inserted into the casing 12. The cap 70 is then moved axially and then rotated slightly to engage the bayonet joints 74, 75. The cap 70 is permanently secured to the casing 12 by conventional ultrasonic welding thereof.

The assembly 10 is completed by inserting the sealing "O" ring 26 and partition 30 into the front end of the casing 12 and then attaching the baffle 40 to the casing 12 by engaging the bayonet joints 44, 46.

To fill the chamber 82 with water, the casing 12 will be turned axially vertical, and the baffle 40 will be removed. Water will be poured into the casing 12 until it reaches depth D1; see FIG. 4. The end 80' of heater assembly 80 will now be horizontal. Then baffle 40 is attached to the open end of the casing. When the casing is turned to an axially horizontal position the depth of water in the chamber 82 will be less than depth D2, i.e. the distance from the bottom of the chamber 82 to the bottom of the opening 38 in the partition 30. In operation of the steamer 10 at various angles of tilt the water will remain in chamber 82 while it is turned into steam by the energized heater assembly. If the casing 15 turned to axially vertically position with the front end pointing downward, water may spill out chamber 82 by passing through the partition 30 to the chamber 62. There the water will rise no higher than the length of the tube 60 which will now be vertical. Thus, the water cannot spill or spray out of the device at any time regardless of the angular position of the casing. When the casing 2 is turned to axially horizontal position, the funnel-like partition will guide the spilled water back into the chamber 82.

The steam generated in the chamber 82 will be guided and expanded into a wide stream as it passes the partition 30. Then the steam will pass through the tube 60 and out of the holes 52, 54 in the baffle 40.

Figure 3:
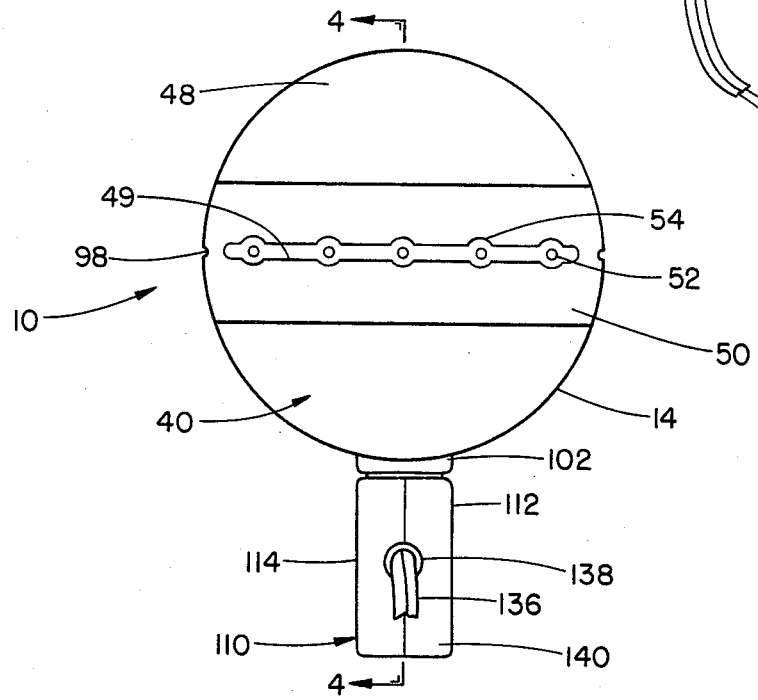
FIG. 3 is a front end elevational view taken along line 3—3 of FIG. 2.

When not in use, the handle 110 may be turned to the retracted position shown in FIGS. 2, 3, and 4 where it is axially parallel to the axis of the casing 12. The handle 110 will be held in place by the detent means 103, 120. When the device is in use the handle 110 will be turned to the extended position shown in FIG. 1, and shown by dotted lines in FIG. 2. Again the detent means 103, 120 will hold the handle in place. The lateral inward pressure exerted by the flexed ends 116 of the handle sides will insure that the handle remains in the selected position. The flat, inclined end walls 48 of the baffle 40 may be used as ironing surfaces on garments and fabrics.

The steamer device is made for the most part of lightweight plastic parts so that it is easy to hold while in use. The plastic parts serve as thermal insulators so that the handle is always comfortably cool. The plastic casing and baffle serve a thermal insulators to prevent heat from escaping laterally from the device and avoiding undesired condensation of the steam, as occurs in prior steamer devices. Since water cannot leak out of the device regardless of the position in which it is disposed, the user can carry the device filled with water in luggage while traveling. This is a great convenience. It is an advantage over prior steamers from which the water had to be emptied after use to avoid leakage while traveling, and which had to be refilled before they could be used again. Since the water can remain at all times in the present steamer device, it is always ready for instant use and does not have to be refilled with water, unless the water is consumed.

It should be understood that the foregoing relates to only a preferred embodiment of the invention which has been by way of example only and that it is intended to cover all changes and modifications of the example of the invention herein chosen for the purpose of the disclosure, which do not constitute departures from the spirit and scope of the invention.

What is claimed is:

1. A steamer device comprising:

a cylindrical casing open at opposite ends;

a handle pivotally attached to said casing for holding said casing said handle moveable in either of two positions respectively perpendicular and parallel to said casing;

a baffle attachable to one end of said casing, said baffle being quickly removable for filling said casing with water to be turned into steam, said baffle having a plurality of perforations extending from a front end to an open rear end of said baffle for passing said steam from said casing, and an open ended flattened tube extending substantially across the diameter of said cylindrical casing inside said baffle and aligned with said perforations;

a cap secured to and closing the other end of said casing;

a heater assembly in said casing for generating said steam therein;

a bracket supporting said heater assembly in said casing and closing a rear end of a first chamber wherein said steam is generated; and a funnel shaped partition defining a front end wall for closing a front end of said first chamber and for containing said water therein which is to be turned into steam by said heater assembly, said funnel shaped partition having a central opening aligned with said flattened tube for passing said steam through said partition and through said baffle while retaining said water in said first chamber, said funnel shaped partition arranged to direct any of said water which may spill out of said first chamber around the outside of said flattened tube in said baffle and thereby prevent water from spilling out of said steamer.

2. A steamer device as defined in claim 1, further comprising means pivotally mounting said handle to said cup; and detent means arranged to hold said handle releasably and selectively in said two positions.

3. A steamer device as defined in claim 1, further comprising first sealing means between said partition and said casing to seal said first chamber at its front end; and second sealing means between said bracket and said casing to seal said first chamber at its rear end.

4. A steamer device as defined in claim 1, wherein said baffle has at least one flat end wall inclined to the axis of said cylindrical casing and usable as an ironing surface.

5. A steamer device as defined in claim 1, further comprising a block joined to said cap;

pivot means on said block rotatably supporting said handle; and detent means on said block and handle releasably and selectively holding said handle in said two positions.

6. A steamer device as defined in claim 5, wherein said block and said handle have passages therethrough for passing an electric cable into said cap for connection to said heater assembly.

7. A steamer device as defined in claim 6, wherein said partition has an apertured extension in said cap for passing wires from said heater assembly to said cap to connect said cable in circuit with said heater assembly.

8. A steamer device as defined in claim 7, further comprising switch means mounted in said cap and connected in circuit with said cable and said heater assembly.

9. A steamer device as defined in claim 5, wherein said handle is an elongated hollow body having spaced plate-like ends formed with cross grooves to render them slightly flexible so that said detent means can releasably engage and disengage under lateral pressure imparted by said flexed ends of said handle.

10. A steamer device as defined in claim 9, wherein said block and said handle having passages therethrough for passing an electric cable into said cap for connection to said heater.

* * * * *